US010196816B2

(12) United States Patent
Bergman

(10) Patent No.: US 10,196,816 B2
(45) Date of Patent: Feb. 5, 2019

(54) CEILING SYSTEM

(71) Applicant: ARMSTRONG WORLD INDUSTRIES, INC., Lancaster, PA (US)

(72) Inventor: Todd M. Bergman, Lititz, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 15/612,470

(22) Filed: Jun. 2, 2017

(65) Prior Publication Data

US 2017/0268228 A1 Sep. 21, 2017

Related U.S. Application Data

(62) Division of application No. 14/935,562, filed on Nov. 9, 2015, now Pat. No. 9,670,673.

(51) Int. Cl.

| | |
|---|---|
| ***E04B 9/04*** | (2006.01) |
| ***E04B 9/30*** | (2006.01) |
| ***E04F 13/00*** | (2006.01) |

(52) U.S. Cl.

CPC ..... *E04B 9/04* (2013.01); *E04B 9/303* (2013.01); *E04F 13/005* (2013.01); *E04B 2009/0492* (2013.01)

(58) Field of Classification Search

CPC .... E04B 2009/0492; E04B 9/303; E04B 9/04; E04F 13/005; G09F 15/0012; G09F 1/12

See application file for complete search history.

(56) References Cited

U.S. PATENT DOCUMENTS

| | | | | |
|---|---|---|---|---|
| 3,448,551 | A | 6/1969 | Heller | |
| 3,460,299 | A | 8/1969 | Wilson | |
| 5,129,202 | A | 7/1992 | Payne et al. | |
| 5,413,300 | A * | 5/1995 | Hosteing | B44C 7/022 248/317 |
| 5,832,685 | A | 11/1998 | Hermanson | |
| 6,132,666 | A | 10/2000 | Foley et al. | |
| 6,499,262 | B1 * | 12/2002 | Pinchot | E04B 9/001 160/327 |
| 7,765,762 | B2 | 8/2010 | Gulbrandsen et al. | |
| 8,337,976 | B2 * | 12/2012 | Mayers | E04B 9/045 156/62.8 |
| 8,646,238 | B2 | 2/2014 | Gulbrandsen | |
| 9,238,912 | B1 * | 1/2016 | Pham | E04B 9/001 |

(Continued)

FOREIGN PATENT DOCUMENTS

GB 894067 A 4/1962

*Primary Examiner* — Andrew J Triggs
(74) *Attorney, Agent, or Firm* — Craig M. Sterner

(57) ABSTRACT

A ceiling system including: a ceiling structure suspended in an interior space. The ceiling structure includes: a perimeter frame defining a central opening, the perimeter frame comprising a fabric gripping member; a support grid comprising a plurality of intersecting struts defining a plurality of grid openings, the support grid disposed within the central opening and coupled to the perimeter frame; a plurality of acoustic ceiling panels, each of the acoustic ceiling panels mounted to the support grid and disposed in one of the grid openings; and a tensioned fabric sheet having a perimeter portion that is engaged by the fabric gripping member of the perimeter frame, the tensioned fabric sheet located below the acoustic ceiling panels and covering the central opening.

11 Claims, 15 Drawing Sheets

(56) References Cited

U.S. PATENT DOCUMENTS

| | | | | |
|---|---|---|---|---|
| 9,670,673 | B2 * | 6/2017 | Bergman | E04B 9/04 |
| 9,745,748 | B2 * | 8/2017 | Bergman | E04B 9/245 |
| 2004/0016184 | A1 | 1/2004 | Huebsch et al. | |
| 2004/0117957 | A1 * | 6/2004 | Kintzing | E04B 9/303 24/545 |
| 2005/0150616 | A1 | 7/2005 | McConnell et al. | |
| 2005/0166506 | A1 | 8/2005 | Morelissen et al. | |
| 2005/0211500 | A1 | 9/2005 | Wendt et al. | |
| 2010/0077686 | A1 | 4/2010 | Bowen | |
| 2010/0077688 | A1 | 4/2010 | Bowen | |
| 2011/0061320 | A1 * | 3/2011 | Scherer | E04F 13/005 52/222 |
| 2017/0130455 | A1 * | 5/2017 | Bergman | E04B 9/245 |
| 2017/0130456 | A1 * | 5/2017 | Bergman | E04B 9/04 |
| 2017/0268228 | A1 * | 9/2017 | Bergman | E04B 9/04 |

* cited by examiner

CEILING SYSTEM

CROSS-REFERENCE TO RELATED APPLICATIONS

This application is a divisional of U.S. patent application Ser. No. 14/935,562 filed on Nov. 9, 2015. The disclosure of the above application is incorporated herein by reference.

BACKGROUND

The present invention generally relates to ceiling systems, and more particularly to suspended ceiling systems which create a seamless appearance.

One of the biggest challenges for acoustic ceilings is the balance between acoustic performance and visual appearance. On one extreme, acoustic ceilings which are integrally formed with the top surface of a space sacrifice significant acoustic performance in favor of a very uniform and seamless visual appearance. On the other extreme, acoustic ceilings formed of acoustic ceiling panels installed within a grid system are able to significantly increase the acoustic performance of the acoustic ceiling, but only at the sacrifice of a seamless visual appearance. Acoustic ceilings have therefore been introduced which hide the grid system, by concealing it within the edges of the supported acoustic ceiling panels, in order to present a more visually appealing appearance to the ceiling. However, it is inescapable that a grid of acoustic ceiling panels, even with a hidden grid system, can still appear as a grid of acoustic ceiling panels. Therefore, an improved ceiling system is desirable, particularly one which is better able to decouple visual appearance from acoustic performance.

BRIEF SUMMARY

The present invention provides a ceiling system including a ceiling structure suspended in an interior space. The ceiling structure includes: a perimeter frame defining a central opening, the perimeter frame including: a first fabric gripping member; and a second fabric gripping member; a first tensioned fabric sheet having a perimeter portion that is engaged by the first fabric gripping member of the perimeter frame, the first tensioned fabric sheet covering the central opening; and. a second tensioned fabric sheet having a perimeter portion that is engaged by the second fabric gripping member of the perimeter frame, the second tensioned fabric overlying the first tensioned fabric.

According to yet another embodiment, a ceiling system including a ceiling structure suspended in an interior space. The ceiling structure includes a perimeter frame defining a central opening, the perimeter frame including: a fabric gripping member; a track comprising a first retaining element configured to couple the fabric gripping member to the track and a second retaining element configured to couple the fabric gripping member to the track; and the fabric gripping member coupled to a selected one of the first or second retaining elements; and a tensioned fabric sheet having a perimeter portion that is engaged by the fabric gripping member of the perimeter frame, the tensioned fabric covering the central opening.

According to yet another embodiment, a fabric gripping apparatus includes: an anchor plate; a gripping portion including: a first wall extending outward from a first surface of the anchor plate; a second wall extending outward from the first surface of the anchor plate and extending substantially orthogonal to the anchor plate along a first reference plane, the second wall comprising a base section and a first gripping section having a plurality of first teeth; a fabric collection cavity formed between the first wall and the base section of the second wall; a gripping plate connected to a distal end of the first wall, the gripping plate comprising a lever section and a second gripping section having a plurality of second teeth; and the gripping plate positioned so that the second teeth oppose the first teeth to form an access slot into the fabric collection cavity, the gripping plate oriented so that the lever section of the gripping plate diverges from the first reference plane with distance from the anchor plate.

Other embodiments of the present invention include a ceiling system comprising a ceiling structure suspended in an interior space, the ceiling structure comprising a perimeter frame defining a central opening, the perimeter frame comprising: a fabric gripping member; a track comprising an upstanding wall having an inner surface opposite an outer surface; and the fabric gripping member coupled to the inner surface of the upstanding wall; and a tensioned fabric sheet having a perimeter portion that is engaged by the fabric gripping member, wherein the tensioned fabric extends from the inner surface of the upstanding wall and across the outer surface of the upstanding wall to cover the central opening of the perimeter frame.

Other embodiments of the present invention include a ceiling system comprising a ceiling structure suspended in an interior space, the ceiling structure comprising a perimeter frame defining a central opening, the perimeter frame comprising: a fabric gripping member; a track comprising an upstanding wall having an inner surface opposite an outer surface, the fabric gripping member coupled to the inner surface of the upstanding wall; and a tensioned fabric sheet having a perimeter portion that is engaged by the fabric gripping member, a tensioned fabric sheet having a perimeter portion that is engaged by the fabric gripping member of the perimeter frame, the tensioned fabric covering the central opening; wherein the inner surface of the upstanding wall circumscribes the perimeter portion of the tensioned fabric sheet.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
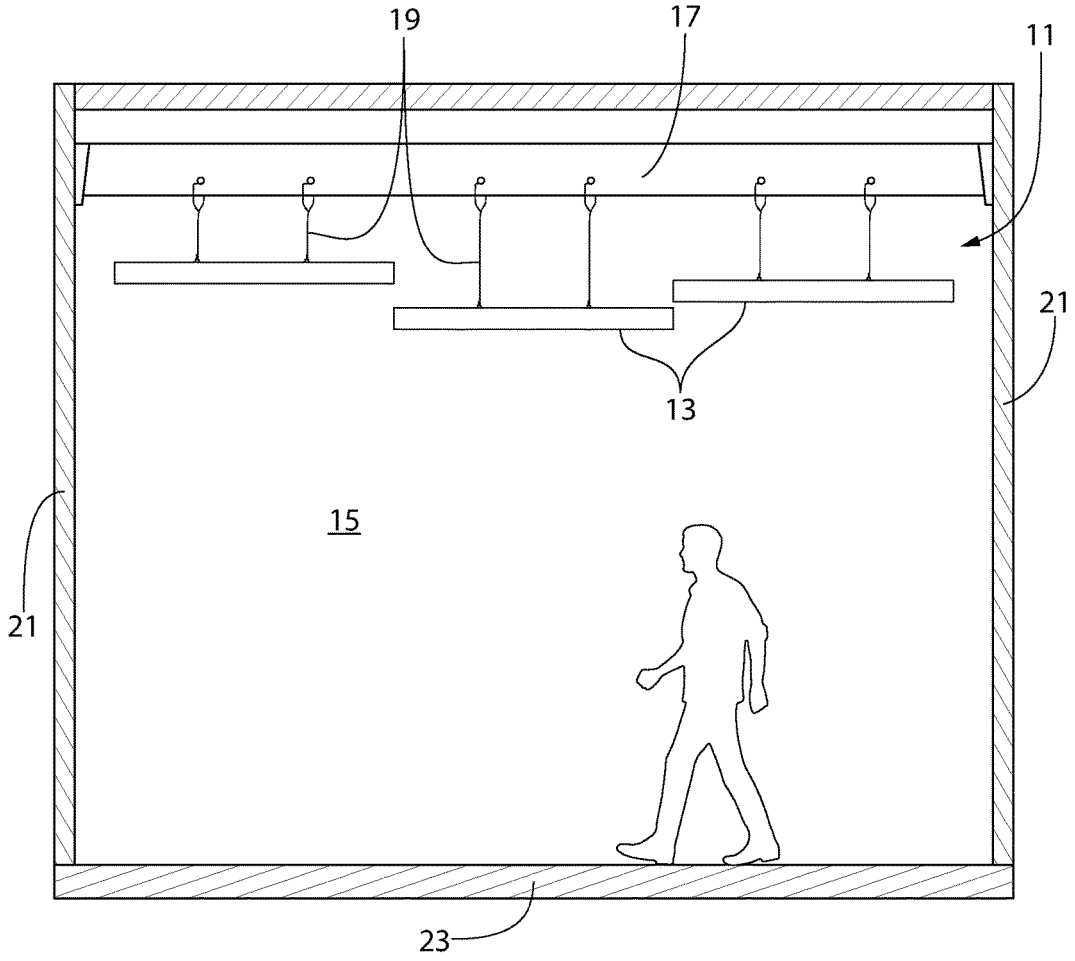
FIG. 1 is a side cross-section view of a plurality of ceiling structures suspended in an interior space to form a ceiling system.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "affixed," "connected," "interconnected," and the like refer to a relationship wherein structures are secured or attached to one another either directly or indirectly through intervening structures, as well as both movable or rigid attachments or relationships, unless expressly described otherwise.

FIG. 1 illustrates a ceiling system 11 including a plurality of ceiling structures 13 installed within an interior space 15. Each ceiling structure 13 is suspended from an overhead structure 17 of the interior space 15 by a plurality of suspension members 19, such that each ceiling structure 13 is spaced apart from the overhead structure 17 and suspended in a free-hanging manner below the overhead structure 17. In certain embodiments, the overhead structure 17 may be a beam or other structural member of the interior space 15, and the suspension members 19 may be wires, cables, tie rods, hangers, struts, and the like. Each ceiling structure 13 is suspended from the overhead structure 17 of the interior space 15 without being directly affixed to any wall 21 of the interior space 15. Each ceiling structure 13 is also not directly affixed to any of the other ceiling structures 13. Thus, in certain embodiments, one or more ceiling structures 13 may be suspended within the interior space 15 solely by the suspension members 19. Although each of the ceiling structures 13 are shown as being parallel to the floor 23 of the interior space 15 and to each other, in certain embodiments one or more of the ceiling structures 13 may be suspended so that it is non-parallel to the floor 23 and/or non-parallel to one or more of the other ceiling structures 13.

Being suspended in a free-hanging manner, however, is not a requirement for all embodiments. Thus, in certain embodiments, one or more of the ceiling structures 13 may be suspended within the interior space 15 so as to be partially or entirely spaced from all walls 21 of the interior space 15. Additionally, in embodiments having one or more ceiling structures 13, any one or more of the ceiling structures 13 may be directly coupled to one or more of the walls or one of the other ceiling structures 13. When the ceiling structure 13 is coupled to a wall or other ceiling structure 13, such coupling is not necessary to provide structural support to any of the ceiling structures 13. Rather, directly coupling any one or more of the ceiling structures 13 to one or more of the walls or to one or more of the other ceiling structures 13 may be done to create differences in the overall visual appearance of the interior space 15.

In still other embodiments, only one ceiling structure 13 may be included in an interior space, such that the one ceiling structure 13 spans from wall to wall of the interior space, thereby enabling uniform acoustic performance across the interior space, while at the same time allowing the presentation of a desired seamless visual appearance that is decoupled from the acoustic performance of the ceiling structure 13.

In still other embodiments, the ceiling system 11 may include one or more ceiling structures 13 installed in a space which includes an overhead structure 17 and is not bounded by walls. Such an embodiment is possible because walls are not required to provide structural support to the ceiling structures 13 that form the ceiling system 11.

Figure 2:
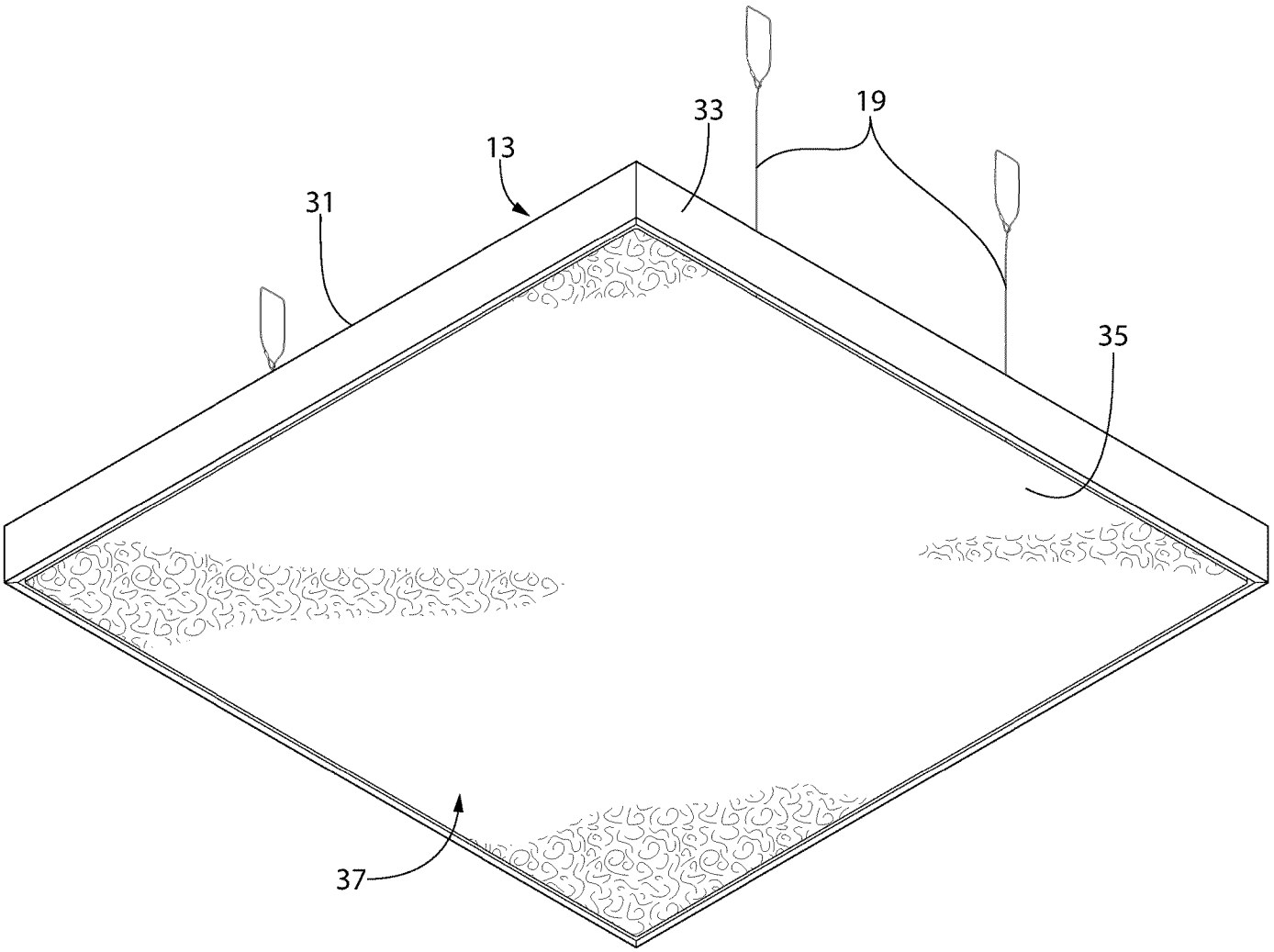
FIG. 2 is a bottom perspective view of a first ceiling structure and suspension members.

Turning to FIG. 2, a bottom perspective view of a ceiling structure 13 is shown. The ceiling structure 13 includes a perimeter frame 31 forming a side periphery 33 of the ceiling structure 13 and a tensioned fabric sheet 35 coupled to the perimeter frame 31 to form a bottom face 37 of the ceiling structure 13. The tensioned fabric sheet 35 has a perimeter portion secured to the perimeter frame 31 along the entire periphery of the bottom face 37 of the ceiling structure 13 so that the tensioned fabric sheet 35 presents a seamless visual appearance. In the embodiment shown, only a small perimeter portion of the bottom face 37 is not covered by the tensioned fabric sheet 35. By attaching the tensioned fabric sheet 35 to the perimeter frame 31 in this manner, the side periphery 33 of the ceiling structure 13 remains exposed to view. In certain embodiments, the side periphery 33 of the ceiling structure 13 formed by the perimeter frame 31 is unbroken by holes or seams, with the exception of at the corners of the perimeter frame 31, so that the side periphery 33 also presents a seamless visual appearance.

Figure 3:
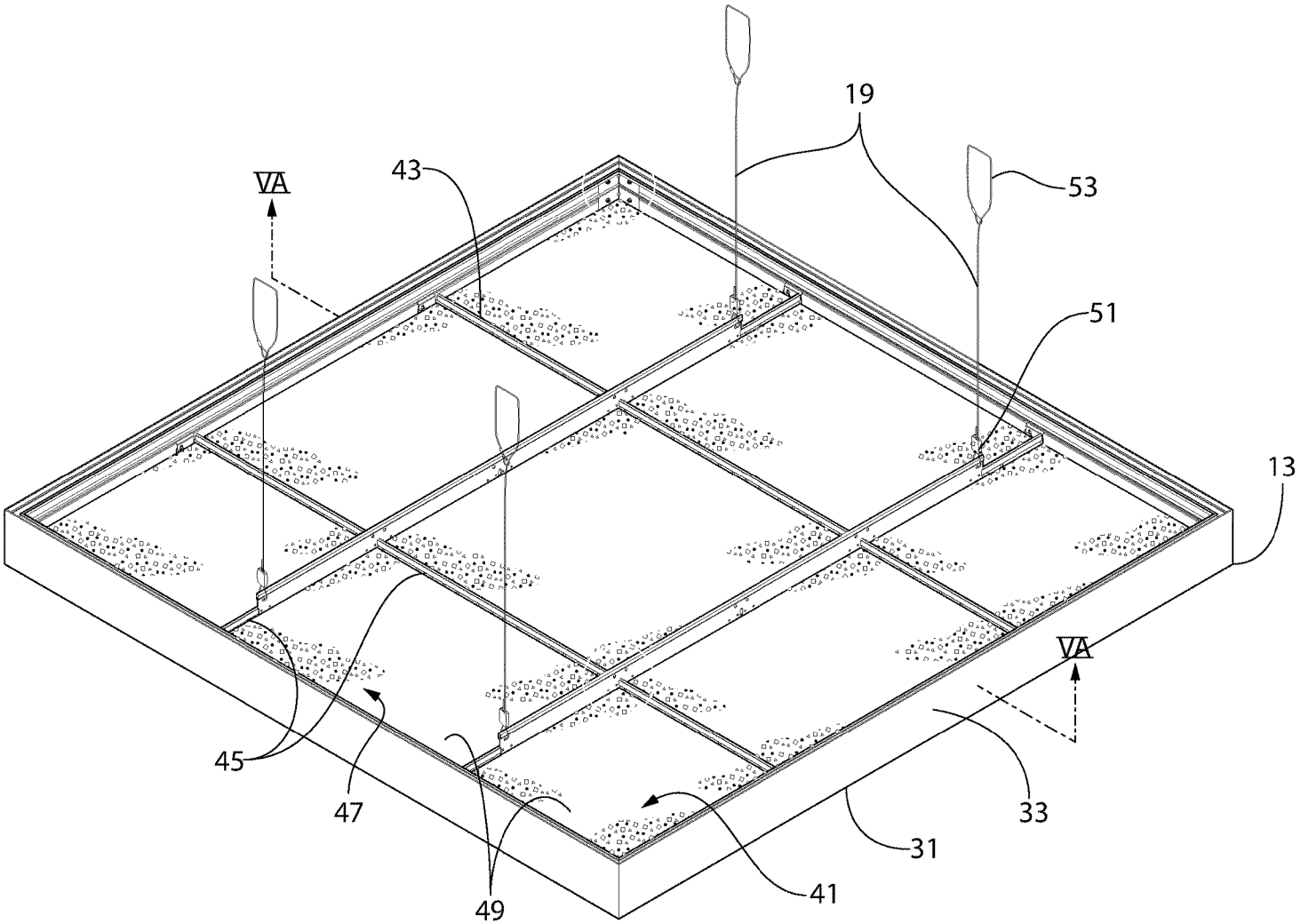
FIG. 3 is a top perspective view of the first ceiling structure and suspension members.

A top perspective view of the ceiling structure 13 is shown in FIG. 3. As can be seen in this view, the perimeter frame 31 forms a central opening 41, and a support grid 43 having a plurality of intersecting struts 45, forming a plurality of grid openings 47, is coupled to the perimeter frame 31 within the central opening 41. The manner in which the support grid 43 is coupled to the perimeter frame 31 is a matter of design choice, and is not to be limiting of the invention. A plurality of acoustic ceiling panels 49 are mounted to the support grid 43, with each acoustic ceiling panel 49 being disposed in one of the grid openings 47. In the embodiment shown, the perimeter frame 31 is shown as being a square and the support grid 43 is shown as a rectangular grid. However, in certain embodiments, the perimeter frame 31 may be formed in other shapes, and similarly, the support grid may have other grid patterns, such as square, hexagonal, and the like.

Because the tensioned fabric sheet 35 spans across the entire central opening 41 of the perimeter frame 31, the appearance of the acoustic ceiling panels 49 may be entirely irrelevant because they are blocked from view by the tensioned fabric sheet 35. Therefore the acoustic performance of the acoustic ceiling panels 49, in certain embodiments, may be improved because there is no need for the acoustic ceiling panels 49 to strike a balance between acoustic performance and aesthetic appearance.

The support grid 43, in addition to supporting the acoustic ceiling panels 49, also serves as a support assembly for the ceiling structure 13. The suspension members 19 have a first end 51 coupled to the support grid 43 and a second end 53 that is configured to couple to the overhead structure 17 of the interior space 15. Thus, when the ceiling structure 13 is suspended, it is suspended entirely by the support grid 43 functioning as a support assembly. In certain embodiments, the acoustic ceiling panels 49 may be omitted, such that the support grid 43 may have a structure that need not be configured to support the acoustic ceiling panels 49. In still other embodiments, the support grid 43, as a support assembly, need not be a grid at all, but rather configured purely as a support assembly for the ceiling structure 13.

Figure 4:
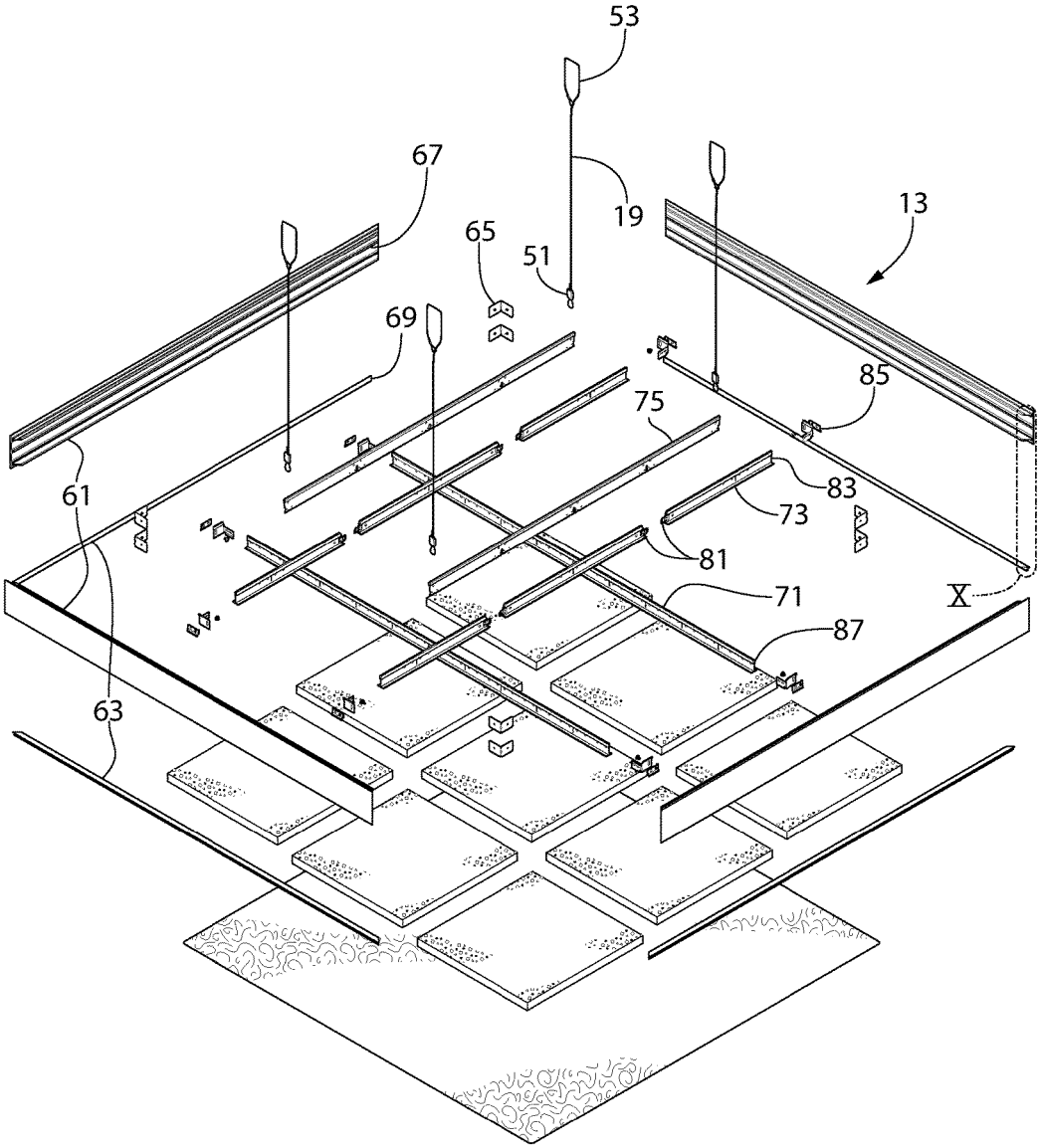
FIG. 4 is an exploded view of the first ceiling structure and suspension members.

In the exploded view of the ceiling structure 13 shown in FIG. 4, the various parts of the ceiling structure 13 are shown, and the details of the inter-couplings between the various parts are described in conjunction with other figures. The perimeter frame 31 includes elongated frame members 61 and elongated grip bars 63 coupled to each elongated frame member 61. Each elongated frame member 61 is coupled to an adjacent elongated frame member 61 by corner brackets 65, so that when the elongated frame members 61 are all coupled together, the perimeter frame 31 having the central opening 41 is formed. With the elongated frame members 61 coupled to form the perimeter frame 31, the elongated frame members 61 collectively form a track 67 that circumscribes the central opening 41. Similarly, the elongated grip bars 63 are coupled to the elongated frame members 61, so that they are also effectively coupled to the track 67, to circumscribe the central opening 41 and collectively form a fabric gripping member 69. The perimeter portion of the tensioned fabric sheet 35 is coupled to each of the elongated grip bars 63 so that the tensioned fabric sheet 35 is secured to the perimeter frame 31 along the entire periphery of the bottom face 37 of the ceiling structure 13, thereby covering the central opening 41. The elongated grip bars 63 serve to maintain the tensioned fabric sheet 35 in a tensioned state across the central opening 41. As discussed below, in certain embodiments, the ceiling structure 13 may include more than one fabric gripping member 69. Also, in certain embodiments, the fabric gripping member 69 may be coupled to the track 67 in any desired location.

The support grid 43 is formed from the plurality of intersecting struts 45, which include longitudinal strut members 71 (e.g. main beams) and lateral strut members 73 (e.g. cross tees). The longitudinal strut members 71 may be referred to as main beams because in certain embodiments the suspension members 19 may couple to these strut members alone to providing suspension support for the entire ceiling structure 13. The lateral strut members 73 may be referred to as cross tees because these strut members are generally, but not necessarily, supported only by the longitudinal strut members 71 without having suspension members 19 securing them to the overhead structure.

The longitudinal and lateral strut members 71, 73 are elongated in shape having a length greater than their respective width (e.g. at least twice), and in various embodiments lengths substantially greater than their widths (e.g. 3 times or more). The longitudinal strut members 71 may have a substantially greater length than the lateral strut members 73, such that the longitudinal strut members 71 form "runners" or "rails" which are maintained in a substantially parallel spaced apart relationship by the lateral strut members 73. The lateral strut members 73 may be permanently or detachably coupled to and between adjacent (but spaced apart) longitudinal strut members 71 at appropriate intervals. The manner in which the lateral strut members 73 are coupled to the longitudinal strut members 71 is a matter of design choice, and is not to be limiting of the invention. The support grid 43 also includes support members 75 which couple to multiple ones of adjacent (but spaced apart) longitudinal strut members 71, and the first end 51 of the suspension members 19 may be coupled to the support members 75. The support members 75 may also be coupled to adjacent lateral strut members 73 to provide greater stability in the lateral direction. By having the support members 75 coupled to multiple ones of adjacent longitudinal strut members 71, every longitudinal strut member 71 need not be directly coupled to one of the suspension members 19. The combination of the interconnected longitudinal and lateral strut members 71, 73 and the support members 75 helps provide strength and stability to the ceiling structure 13.

The longitudinal and lateral strut members 71, 73 intersect to form an array of grid openings 47 which receive and are closed by ceiling panels 49 when positioned within the grid openings 47. In some embodiments, the longitudinal and lateral strut members 71, 73 may be arranged in an orthogonal pattern to intersect, respectively, at right angles (i.e., perpendicular) to form grid openings 47 which are rectilinear, such as squares or rectangles (in top plan view).

The terminal ends 81 of the lateral strut members 73 that couple to the longitudinal strut members 71 have end connections configured for permanent or detachable connection to the longitudinal strut members 71 at right angles as part of forming the rectilinear grid pattern. The lateral strut members 73 may be coupled to the longitudinal strut members 71 through use of a permanent connection such as, without limitation, welding, soldering, and the like, or through use of a detachable connection such as, without limitation, clips, brackets, threaded fasteners, interlocking tabs/slots, and the like. Accordingly, the present invention is not limited by the manner of attachment or coupling used between the lateral strut members 73 and the longitudinal strut members 71 unless otherwise so limited by the claims.

Similarly, the terminal ends 83 of the lateral strut members 73 that couple to the elongated frame members 61 have end connections configured for permanent or detachable connection to the elongated frame members 61 at right angles as part of forming the rectilinear grid pattern. The lateral strut members 73 may be coupled to the elongated frame members 61 through the use of a support bracket 85. In certain embodiments, the lateral strut members 73 may be coupled to the elongated frame members 61 through the use of any detachable connection such as, without limitation, clips, brackets, threaded fasteners, interlocking tabs/slots, and the like. Accordingly, the present invention is not limited by the manner of attachment or coupling used between the lateral strut members 73 and the elongated frame members 61 unless otherwise so limited by the claims.

The terminal ends 87 of the longitudinal strut members 71 have end connections configured for permanent or detachable end-to-end connection to the elongated frame members 61 to form the continuous spans of the main beams. The longitudinal strut members 71 may likewise be coupled to the elongated frame members 61 through the use of the support bracket 85. In certain embodiments, the longitudinal strut members 71 may be coupled to the elongated frame members 61 through the use of any detachable connection such as, without limitation, clips, brackets, threaded fasteners, interlocking tabs/slots, and the like. Accordingly, the present invention is not limited by the manner of attachment or coupling used between the longitudinal strut members 71 and the elongated frame members 61 unless otherwise so limited by the claims.

The configuration and orientation of the parts forming the support grid 43 may vary widely while still remaining within the scope of the claims. By way of example, some lateral strut members 73 may be run the same direction between and parallel to main beam longitudinal strut members 71, the longitudinal strut members 71 and the lateral strut members 73 may intersect at non-perpendicular angles, any part or all of the support grid 43 may be positioned in a horizontal or other orientation. Any combination of such alternative design characteristics may be incorporated into the ceiling structure 13.

The acoustic ceiling panels 49 may be of any appropriate design to provide the ceiling structure 13 desired acoustical properties. For example, an exemplary acoustic ceiling panel 49 may include at least a core layer (not shown) (not shown) formed from one or more sub-layers. In such an exemplary and non-limiting embodiment, the acoustic ceiling panel 49 has a generally rectangular shape. In other embodiments, the acoustic ceiling panel 49 may be square, have more or fewer peripheral sides, or be irregularly shaped. The core layer of such an exemplary acoustic ceiling panel 49 may be constructed of any suitable material or combinations of different materials, which in certain embodiments preferably have acoustical properties. Some non-limiting examples of core layer materials that may be used include, without limitation, mineral fiber board, fiberglass, metals, polymers, metal, wood, composites, combinations thereof, or other. Embodiments of the core layer may be constructed so that the acoustic ceiling panel 49 has a sufficiently high noise reduction coefficient (NRC) and ceiling attenuation class (CAC) rating to be characterized as an acoustical substrate in contrast to gypsum-based drywall having substantially lower NRCs (e.g. 0.05) characteristic of sound reflecting, not absorbing materials. NRC is a measure of sound energy absorption of a material. An NRC rating of 0 is a perfect sound reflection material. An NRC rating of 1 is a perfect sound absorption material. CAC is a measure for rating the performance of a ceiling material as a barrier to block airborne sound transmission through the material to/from the upper interior space above the suspended ceiling panels and into an adjacent room. This property is measured in decibels (dB).

In some embodiments, the core layer may impart to the acoustic ceiling panel 49 an NRC of at least 0.50 and/or CAC of at least 30 dB depending on the desired acoustical characteristics of the ceiling system. In a certain embodiment, the NRC rating may be at least 0.70. In certain other embodiments, additional acoustic layers and/or features may be included as part of the acoustic ceiling panel 49, along with the core layer, to achieve desired acoustic properties for the acoustic ceiling panel 49.

Figure 5A:
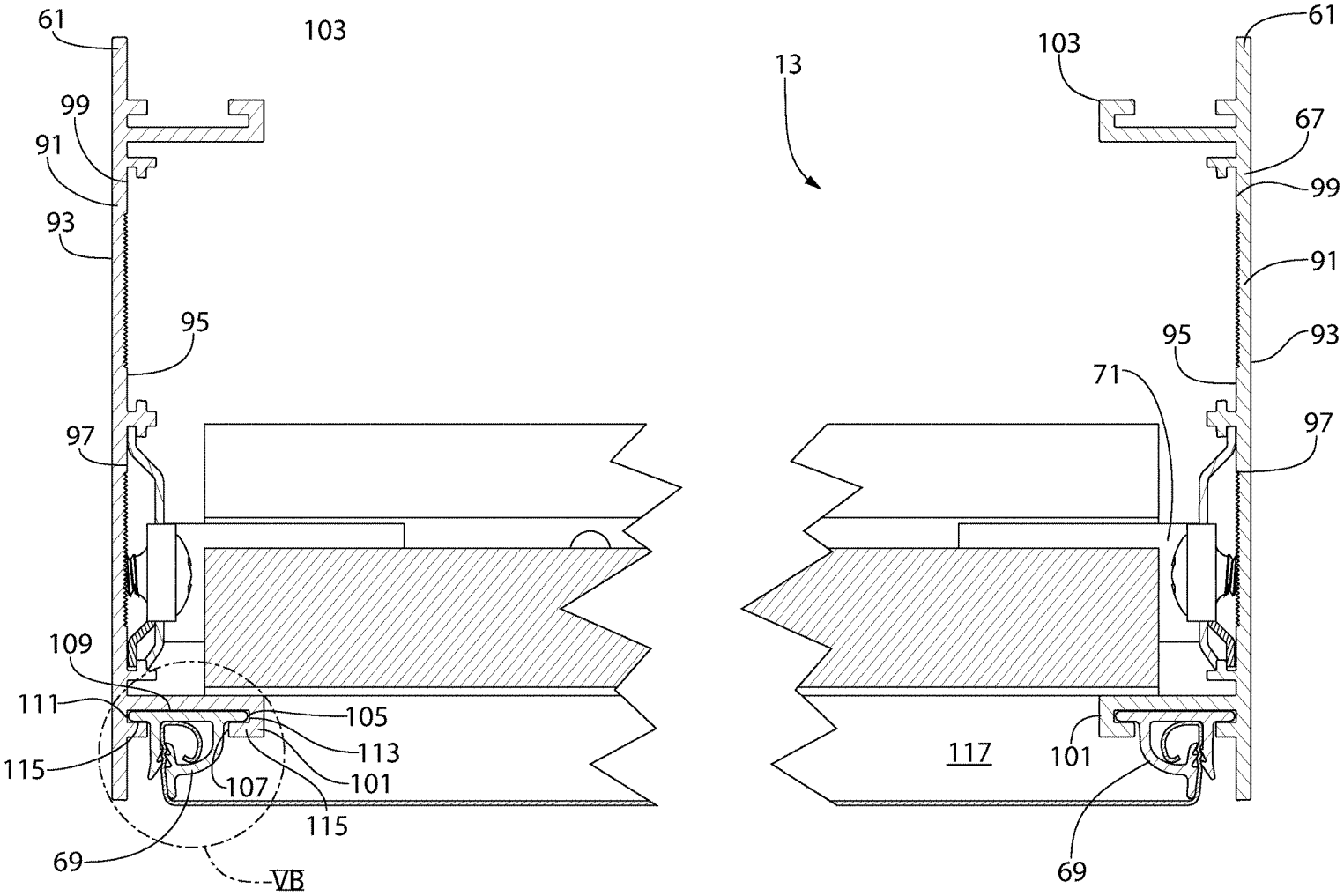
FIG. 5A is a partial cross-sectional view of the first ceiling structure along the line VA-VA of FIG. 3.

FIG. 5A shows a cross sectional view of the ceiling structure 13. Two opposing frame members 61 are each coupled to opposite ends of a longitudinal strut member 71. The profiles of the two frame members 61 show the track 67 that circumscribes the central opening 41 of the perimeter frame 31, and as shown, the track 67 is bilaterally symmetric. In certain embodiments, the track 67 may be partially symmetric, or not symmetric at all.

The track 67 includes an upstanding wall 91 which has an outer surface 93 and an inner surface 95. The inner surface 95 includes a lower support element 97 and an upper support element 99. Each of the lower and upper support elements 97, 99 are configured to couple the support brackets 85 to the perimeter frame 31. The support brackets 85 are discussed in greater detail below. Each of the lower and upper support elements 97, 99 also permit the support brackets 85 to be coupled to the perimeter frame 41 at a first height (the lower support element 97) or at a second height (the upper support element 99), respectively.

A lower retaining element 101 protrudes from the inner surface 95 of the upstanding wall 91 at a bottom portion of the upstanding wall 91, and an upper retaining element 103 protrudes from the inner surface 95 of the upstanding wall 91 at a top portion of the upstanding wall 91. As with the track 67, each of the retaining elements 101, 103 circumscribes the central opening 41 of the perimeter frame 31. In certain embodiments, either one or both of the retaining elements 101, 103 may not circumscribe the central opening 41. In certain embodiments, one or the other of the retaining elements 101, 103 may be omitted.

In the exemplary embodiment depicted, both retaining elements 101, 103 have identical configurations but different orientations, and as such the ensuing description applies to the configurations of both. Therefore, the description of the retaining element 101 applies equally to the retaining element 103, except for where otherwise noted. In certain embodiments, however, the retaining elements 101, 103 may have different configurations. The retaining element 101 includes a retaining channel 105 and an access slot 107 forming a passageway into the retaining channel 105. The access slot 107 of the lower retaining element 101 faces downward, and the access slot 107 of the upper retaining element 103 faces upward. The retaining element 101 also includes a floor 109, a first wall 111, and a second wall 113 that collectively define the retaining channel 105 and access slot 107, and at least one of the walls 111, 113 of the retaining element 101 includes an overhang portion 115. With the retaining element 101 configured in this manner, one of the elongated grip bars 63 may be placed in sliding relationship with the retaining element 101. In certain embodiments, as described in more detail below, the fabric gripping member may be coupled to one or the other of the retaining elements 101, 103. With elongated grip bars 63 coupled to the retaining members 101 of each frame member 61, the fabric gripping member 69 circumscribes the central opening 41. In this configuration, the elongated grip bar 63 protrudes from the inner surface 95 of the upstanding wall 91, from a location at a bottom portion of the upstanding wall 91, so that the outer surface 93 of the upstanding wall 91 remains exposed when the tensioned fabric sheet 35 is coupled to the fabric gripping member 69. In addition, the bottom portion of the upstanding wall 91 circumscribes the tensioned fabric sheet 35. In an alternate configuration, when the fabric gripping member 69 is coupled to the retaining member 103 and the tensioned fabric sheet 35 is coupled to the fabric gripping member 69, the elongated grip bar 63 protrudes from the inner surface 95 of the upstanding wall 91, from a location at a top portion of the upstanding wall 91, so that the tensioned fabric sheet 35 wraps around and at least partially conceals the outer surface 93 of the upstanding wall 91.

As can be seen in FIG. 5A, when the fabric gripping member 69 is coupled to the retaining member 101, a gap 117 exists between a top surface of the tensioned fabric sheet 35 and a bottom surface of each of the acoustic ceiling panels 49. In addition, this configuration also results in the top surface of the tensioned fabric sheet 35 being spaced apart from a bottom surface of the intersecting struts 45, and the spacing may be defined by the same gap 117 in certain embodiments.

Figure 5B:
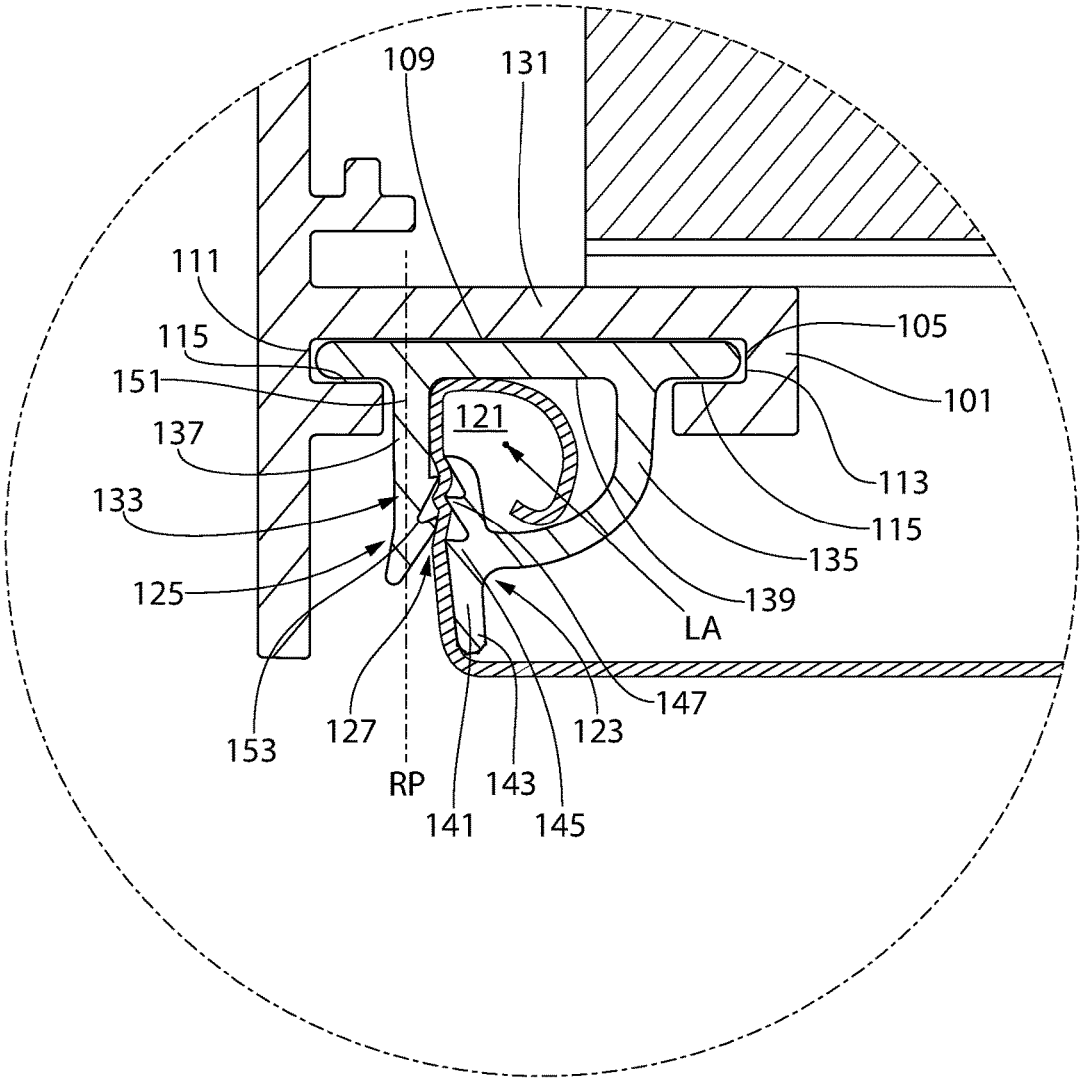
FIG. 5B is a detail view of section VB of FIG. 5A showing the fabric sheet engaged by the fabric gripping member.

A detailed cross-sectional view of one of the elongated grip bars 63 coupled to the one of the retaining members 101 is shown in FIG. 5B. As indicated above, when each frame member 61 of the perimeter frame 31 includes one of the elongated grip bars 63, the collection of elongated grip bars 63 forms the fabric gripping member 69, such that the fabric gripping member 69 circumscribes the central opening 41. The elongated grip bar 63 extends along a longitudinal axis LA, and in certain embodiments, the elongated grip bar 63 may be formed as a singular monolithic component. In certain embodiments, the elongated grip bar 63 may be integrally formed with the frame member 61. For example, the frame member 61 may be formed from extruded aluminum, with the elongated grip bar 63 extruded as an integral part of the frame member 61. In such embodiments, the extruded frame members 61 may include multiple elongated grip bars 63, with each being formed integrally with the lower and upper retaining elements 101, 103, respectively.

The elongated grip bar 63 is configured with a fabric collection cavity 121, a first gripping jaw 123, and a second gripping jaw 125. The first and second gripping jaws 123, 125 oppose one another to form an access slot 127, which forms a passageway into the fabric collection cavity 121. More particularly, the fabric gripping member 69 includes an anchor plate 131 and a gripping portion 133 in the form of the first and second gripping jaws 123, 125. The gripping portion 133 includes a first wall 135 and a second wall 137, both extending outward from a first surface 139 of the anchor plate 131. A gripping plate 141, which includes a lever section 143 and a second gripping section 145 having a plurality of first teeth 147, is connected to the distal end of the first wall 135. In certain embodiments, the first wall 135 may be a curved wall. The second wall 137 extends substantially orthogonal from the anchor plate 131 along a reference plane RP and includes a base section 151 and a gripper section 153 having a plurality of second teeth 155. The gripping plate 141 of the second wall 137 is positioned so that the plurality of first teeth 147 on the gripping plate 141 oppose the plurality of second teeth 155 of the gripper section 153. With this configuration, the first and second gripping jaws 123, 125 and the access slot 127 are formed, and the fabric collection cavity 121 is formed between the first wall 135 and the base section 151 of the second wall 153. The gripping plate 141 of the second wall 137 is oriented so that the lever section 143 diverges from the first reference plane RP the further the lever section 143 extends from the anchor plate 131. In addition, at least one of the first wall 135 or the second wall 137 is resilient, with the first and second teeth 147, 155 are biased into contact with one another. Having such a configuration, the first and second teeth 147, 155 may be drawn apart when an appropriate force is applied to the lever section 143 of the gripping plate 141.

The perimeter portion of the tensioned fabric sheet 35 may be inserted into the fabric collection cavity 121 of the elongated grip bar 63 so that the first and second teeth 147, 155 of the first and second gripping jaws 123, 125 engage the perimeter portion of the tensioned fabric sheet 35 to hold the tensioned fabric sheet 35 in place. The tensioned fabric sheet 35 is therefore prevented from being withdrawn from the fabric collection cavity 121 by the first and second teeth 147, 155, which are biased toward each other.

Figure 6:
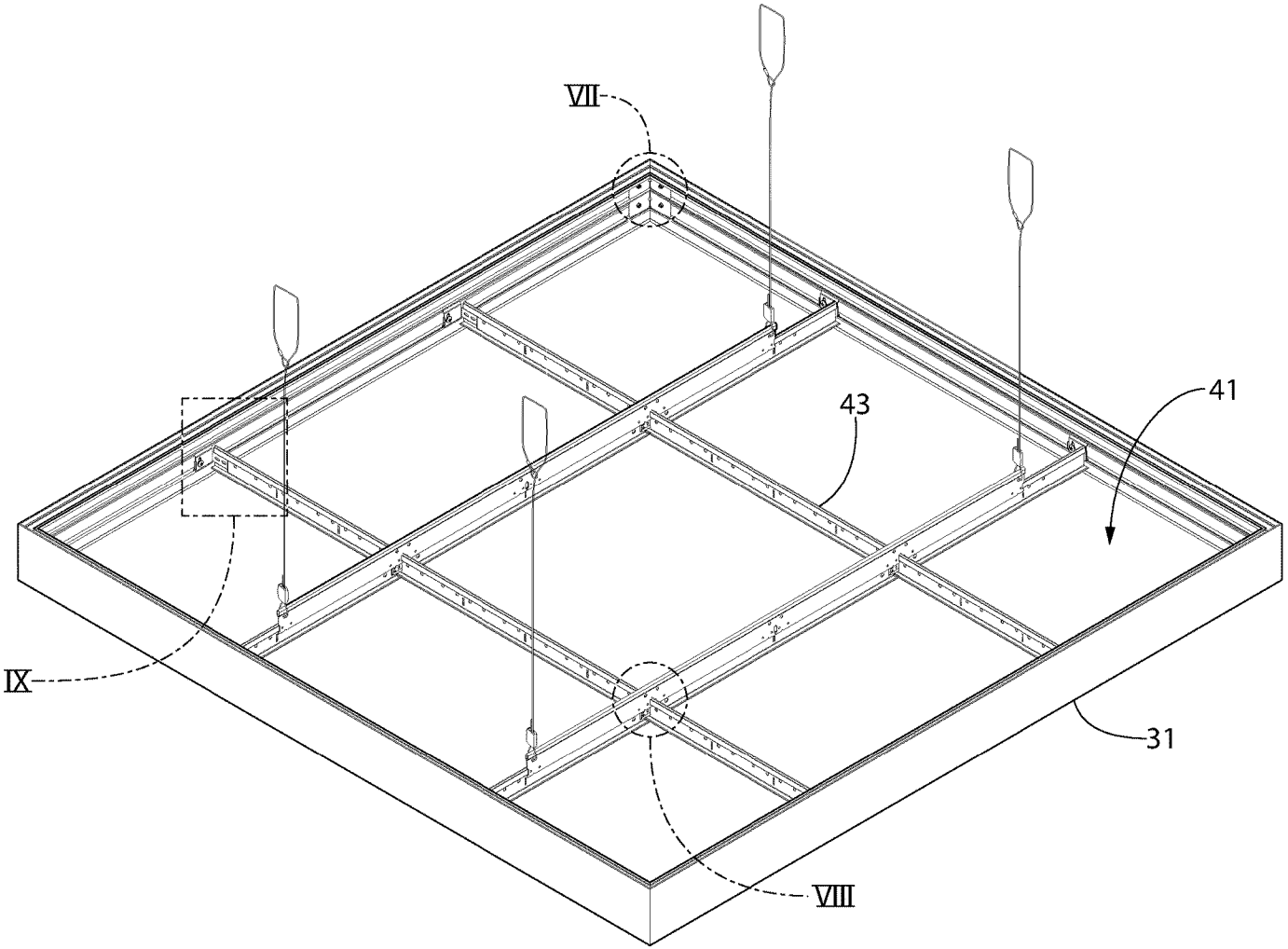
FIG. 6 is a top perspective view of the perimeter frame and the support grid for the first ceiling structure of FIG. 3.
Figure 7:
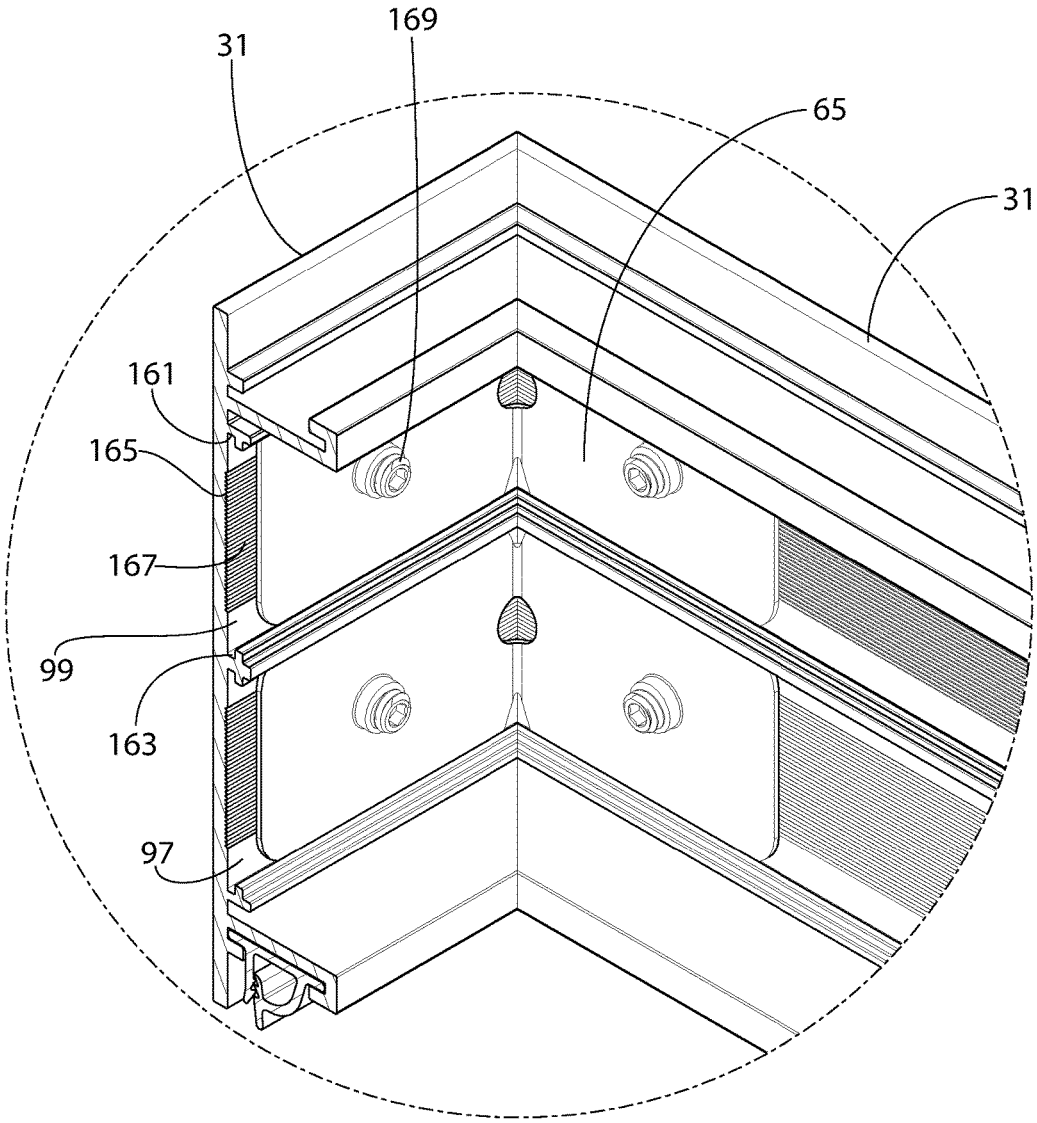
FIG. 7 is a detail view of section VII of FIG. 6 showing coupled frame members.

FIG. 6 shows a perspective view of the perimeter frame 31 forming the central opening 41, with the support grid 43 disposed within the central opening 41 and coupled to the perimeter frame 31. Referring to both FIGS. 6 and 7, adjacent elongated frame members 61 are coupled together by two corner brackets 65. Each corner bracket 65 is seated within one of lower support element 97 and the upper support element 99, both of which are formed on the inner surface 95 of the track 67 formed by the perimeter frame 31.

In the exemplary embodiment depicted, both lower and upper support elements 97, 99 have identical configurations, and as such the ensuing description applies to the configurations of both. Therefore, the description of the upper support element 99 applies equally to the lower support element 97, except for where otherwise noted. In certain embodiments, the lower and upper support elements 97, 99 may have different configurations. The upper support element 99 includes a first channel 161, a second channel 163, and a back wall 165, with the first channel 161 and the second channel 163 facing one another and the back wall 165 separating the first and second channels 161, 163. The back wall 165 includes a surface texturing 167, which may be a plurality of ridges, as depicted, or any other type of texturing that provides a fine-scale non-planar surface for the back wall 165. For each frame member 31 to be adjoined, a first corner bracket 65 is inserted into the upper support element 99 with upper and lower edges of the corner bracket 65 seated, respectively, within the first channel 161 and the second channel 163 of the upper support element 99. Similarly, a second corner bracket 65 is inserted into the lower support element 97 with upper and lower edges of the corner bracket 65 seated, respectively, within the first channel 161 and the second channel 163 of the lower support element 97. Each corner bracket 65 includes a threaded hole (not shown) into which a threaded fastener 169 is inserted, and each threaded fastener 169 engages the threaded hole so that an end of the threaded fastener 169 presses into the texturing 167 of the back wall 165. The surface texturing 167 of the back wall 165 serves to help maintain the threaded fastener 169 in place without slipping. In addition, the pressure of the threaded fastener 169 against the back wall 165 causes the upper and lower edges of the corner bracket 65 to press against the walls of the respective first and second channels 161, 163. The combination of the pressure of the threaded fastener 169 against the back wall 165 and the pressure of the corner bracket 65 against the walls of the first and second channels 161, 163 serves to hold the corner bracket 65 in position with respect to the frame member 31, which in turn serves to secure and hold adjacent frame members 31 together.

Figure 8:
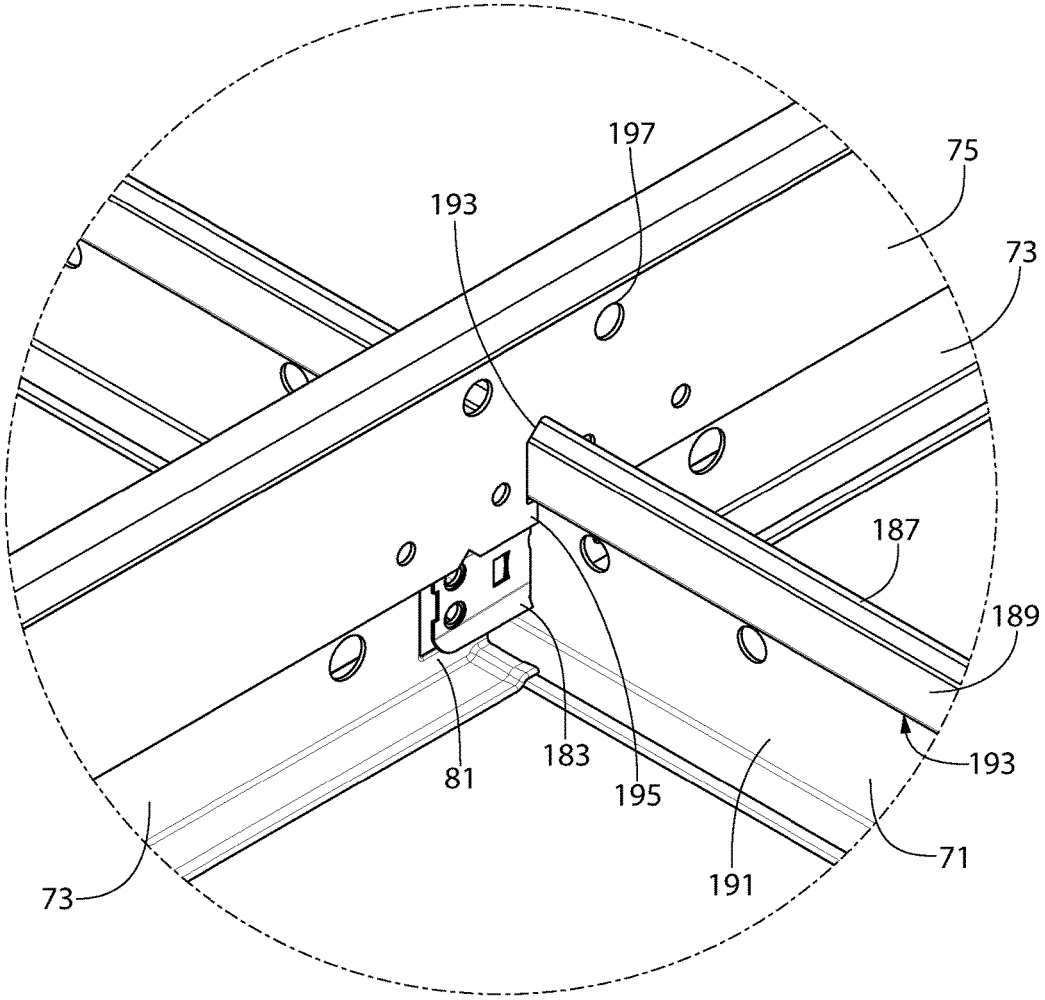
FIG. 8 is a detail view of section VIII of FIG. 6 showing coupled intersecting struts of the support grid.

One intersection 181 of the intersecting struts 45 is shown in FIG. 8. Two lateral strut members 73 are shown coupled to the longitudinal strut member 71. The terminal ends 81 of the lateral strut members 73 each include a coupling extension 183 which engages a coupling slot 185 (also seen in FIG. 9A) formed in the sidewall of the longitudinal strut member 71. The top section 187 of the longitudinal strut member 71 includes a rail 189 which is larger than the middle section 191, and the rail 189 includes downward-facing edges 193 (seen in FIG. 9A). The support member 75 includes a slot 193 which has a shape that is complementary to the shape the rail 189, and slot 193 includes flanges 195 which extend under the downward-facing edges 193 of the rail 189. Holes 197 are included in the support member 75 for attachment to the suspension members 19 (see, e.g., FIG. 3). In certain embodiments, the support member 75 may also be directly coupled to the lateral strut members 73 by a fastener, such as a screw, clip, or other appropriate fastener. Thus, the support member 75 may be placed on the longitudinal strut member 71 with the rail 187 extending through the slot 193, and with the support member 75 coupled to adjacent longitudinal strut members 71 in this same manner. In this manner, the support member 75 may be used to suspend the support grid 43, and thus the entire ceiling structure 13, by attachment of the suspension members 19 to the support members 75.

Figure 9A:
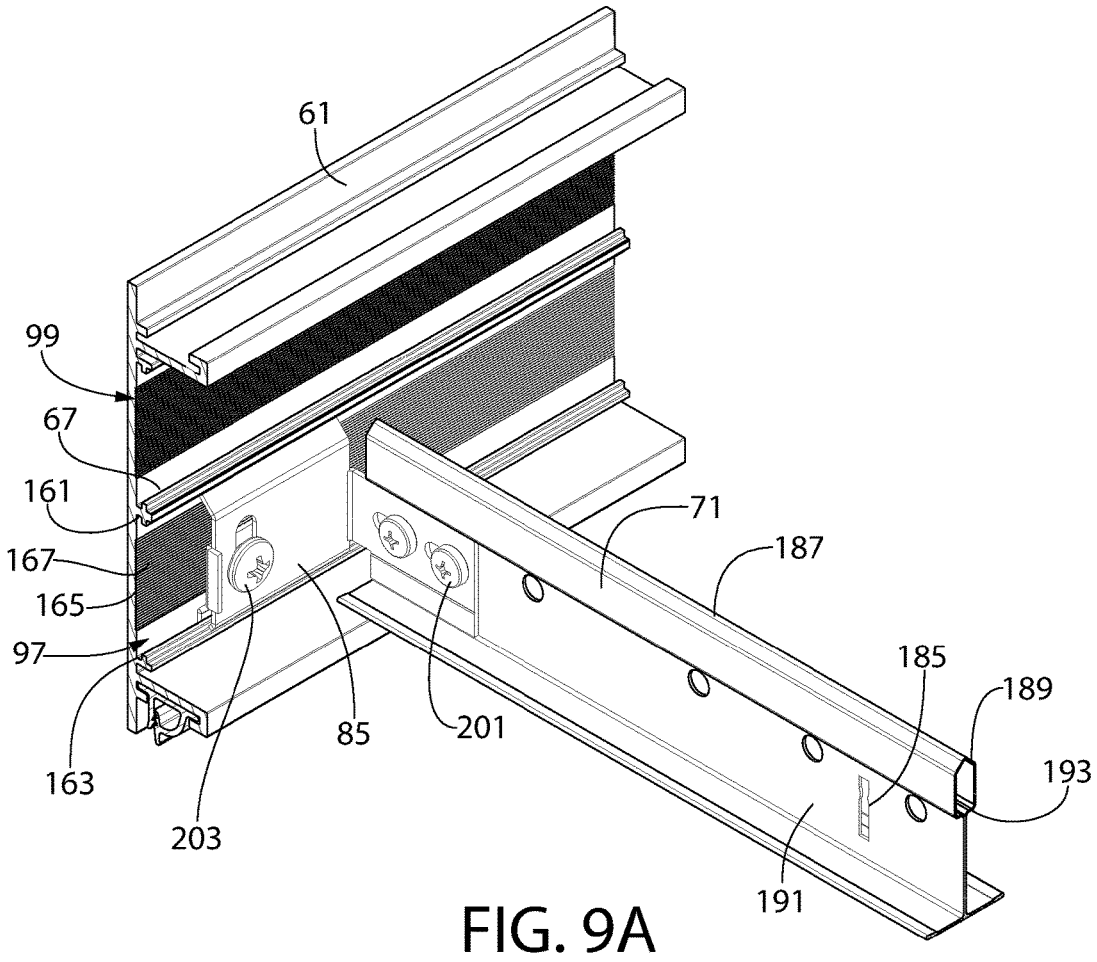
FIG. 9A is a detailed view of section IXA of FIG. 6 showing the strut of the support grid coupled to the frame member of the perimeter frame.

The coupling of a longitudinal strut member 71 to a frame member 61 is shown in FIG. 9A. A lateral strut member 73 may be coupled to a frame member 61 in the same manner. The terminal end 87 of the longitudinal strut member 71 is coupled to the lower support element 97 of the track 67 by the support bracket 85. In certain embodiments, the longitudinal strut member 71 may alternatively be coupled to the upper support element 99 of the track 67 by the support bracket 85. The support bracket 85 is secured to the longitudinal strut member 71 by fasteners 201 and to the lower support element 97 of the track 67 by a threaded fastener 203. In the embodiment shown, the fasteners 201 are shown as screws, although in other embodiments, the fasteners may be clips or any other type of appropriate fastener.

Figure 9B:
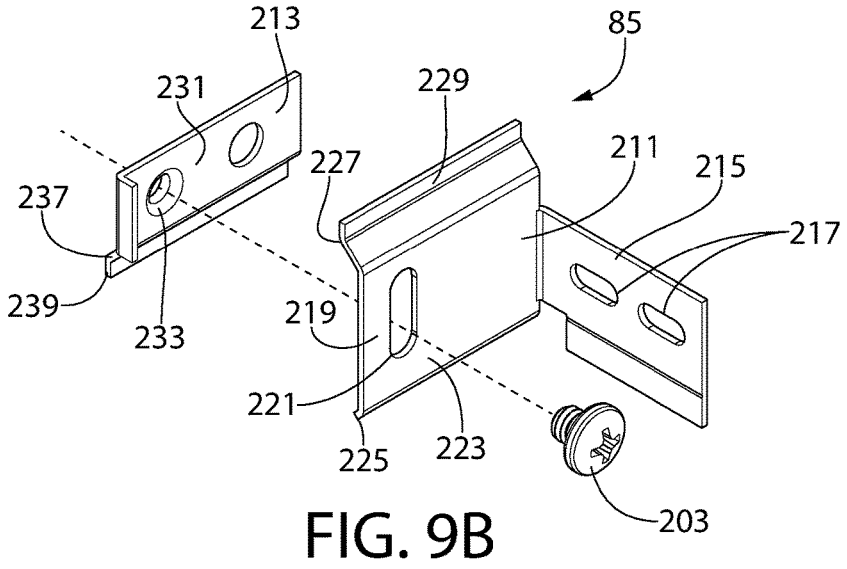
FIG. 9B is an exploded view of a support bracket for a ceiling structure.

The support bracket 85, which is shown in FIG. 9B, includes an "L" bracket member 211 and a clamp member 213. The "L" bracket member 211 includes a first leg 215 with holes 217 for securing the "L" bracket member 211 to the longitudinal strut member 71 (or to a lateral strut member 73) and a second leg 219 with a hole 221 through which the threaded fastener 203 passes. The second leg 219 of the "L" bracket member 211 includes a middle planar portion 223, with the first leg extending from a first side of the middle planar portion 223. The second leg 219 also includes a bottom portion 225 which extends at an acute angle from a second side of the middle planar portion 223, the second side of the middle planar portion 223 being opposite the first side. The second leg 219 also includes a top portion 227 which extends at an acute angle from the second side of the middle planar portion 223 in the opposite direction of the first leg 215. The top portion 227 also includes an engagement leg 229, which is substantially parallel to the middle planar portion 223 and positioned to engage one of the first and second channels 161, 163 of one of the lower and upper support elements 97, 99.

The clamp member 213 includes a middle planar portion 231 with a threaded hole 233 for engaging the threaded fastener 203. A first side of the middle planar portion 231 faces the "L" bracket member 211 when the two are secured together. One end of the middle planar portion 231 includes a stabilizing tab 235 extending from the first side of the clamp member 213, and the stabilizing tab 235 serves to help prevent the clamp member 213 and the "L" bracket member 211 from rotating with respect to each other when coupled together by the threaded fastener 203. The bottom portion 237 of the clamp member 213 extends at an acute angle from the second side of the clamp member 213 in the opposite direction of the stabilizing tab 235. The bottom portion 237 also includes an engagement leg 239, which is substantially parallel to the middle planar portion 231 and positioned to engage the one of the first and second channels 161, 163 of one of the lower and upper support elements 97, 99.

The support bracket 85 secures to one of the lower and upper support elements 97, 99 with the engagement leg 229 of the "L" bracket member 211 positioned in one of the first and second channels 161, 163 and the engagement leg 239 of the clamp member 213 positioned in the other of the first and second channels 161, 163. The bottom portion 225 of the "L" bracket member 211 is located outside of the one of the first and second channels 161, 163 in which the engagement leg 239 of the clamp member 213 is positioned. When the threaded fastener 203 engages the threaded hole 233 of the clamp member 213, the clamp member 213 is drawn toward the "L" bracket member 211, and the threaded fastener 203 presses into the texturing 167 of the back wall 165 of the respective lower and upper support element 97, 99. The texturing 167 of the back wall 165 serves to help maintain the threaded fastener 203 in place without slipping. In addition, the pressure of the threaded fastener 203 against the back wall 165 causes the engagement leg 229 of the "L" bracket member 211 and the engagement leg 239 of the clamp member 213 to press against the walls of the respective first and second channels 161, 163. Also, the a wall of one of the first and second channels 161, 163 is clamped between the bottom portion 225 of the "L" bracket member 211 and the engagement leg 239 of the clamp member 213. Thus, with the threaded fastener 203 coupling the support bracket 85 to one of the lower and upper support elements 97, 99, the support bracket 85 serves to securely couple a longitudinal strut member 71 (or a lateral strut member 73) to the track 67. By using the support bracket 85 to couple the longitudinal and lateral struts 71, 73 to the track 67, the outer surface of the upstanding wall 91 may be formed without any through holes.

Figure 10:
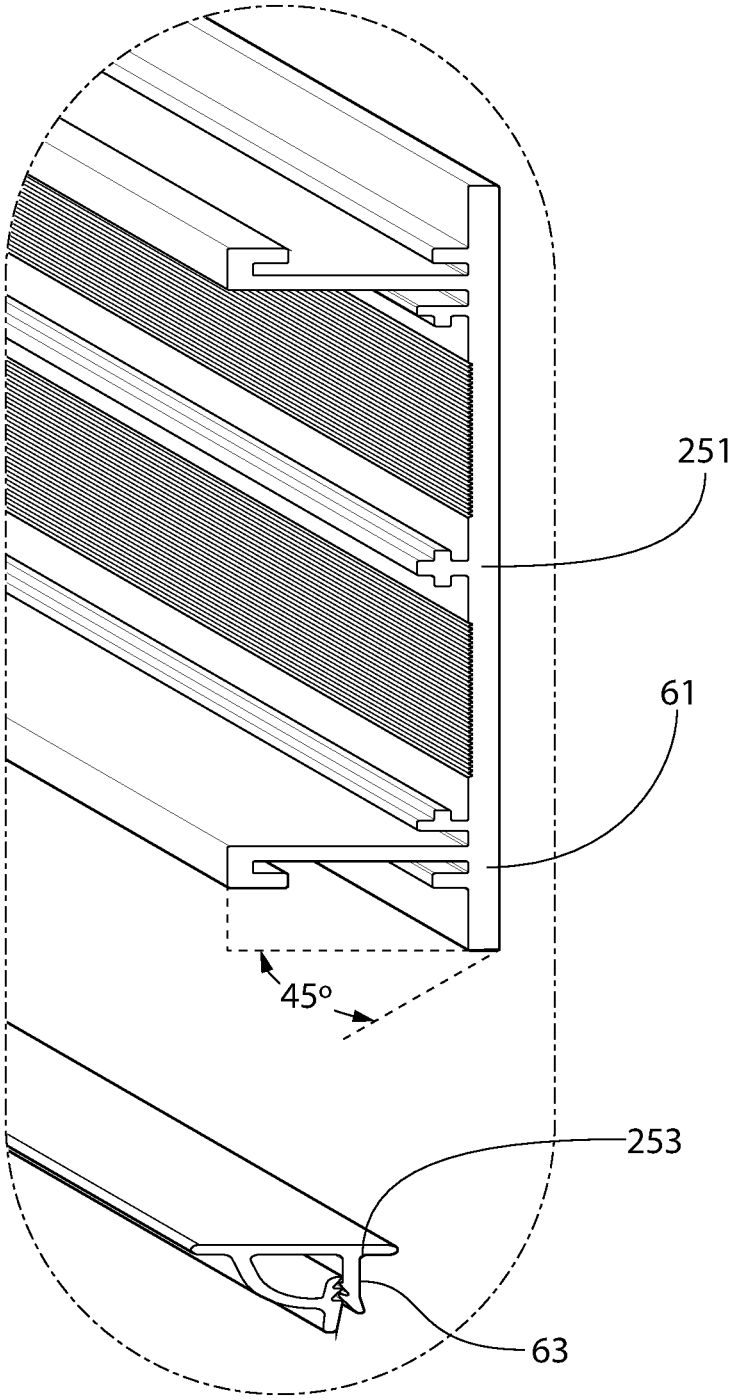
FIG. 10 is a detailed view of section X of FIG. 4 showing the end of a perimeter frame member and a fabric gripping member.

The end of a frame member 61, including the elongated grip bar 63, is shown in FIG. 10. As illustrated, the end 251 of the frame member 61, including the end 253 of the elongated grip bar 63 are mitered at approximately a 45° angle so that four frame members 61 may be assembled together to form a square or rectangular perimeter frame 31 having a central opening 41. In certain embodiments, the frame members 61 may have ends mitered at angles other than 45° so that the resulting perimeter frame 31 has a shape other than square or rectangular. In certain other embodiments, different frame members 61 may have ends mitered at different angles so that the resulting perimeter frame 31 may have an irregular polygonal shape.

Figure 11:
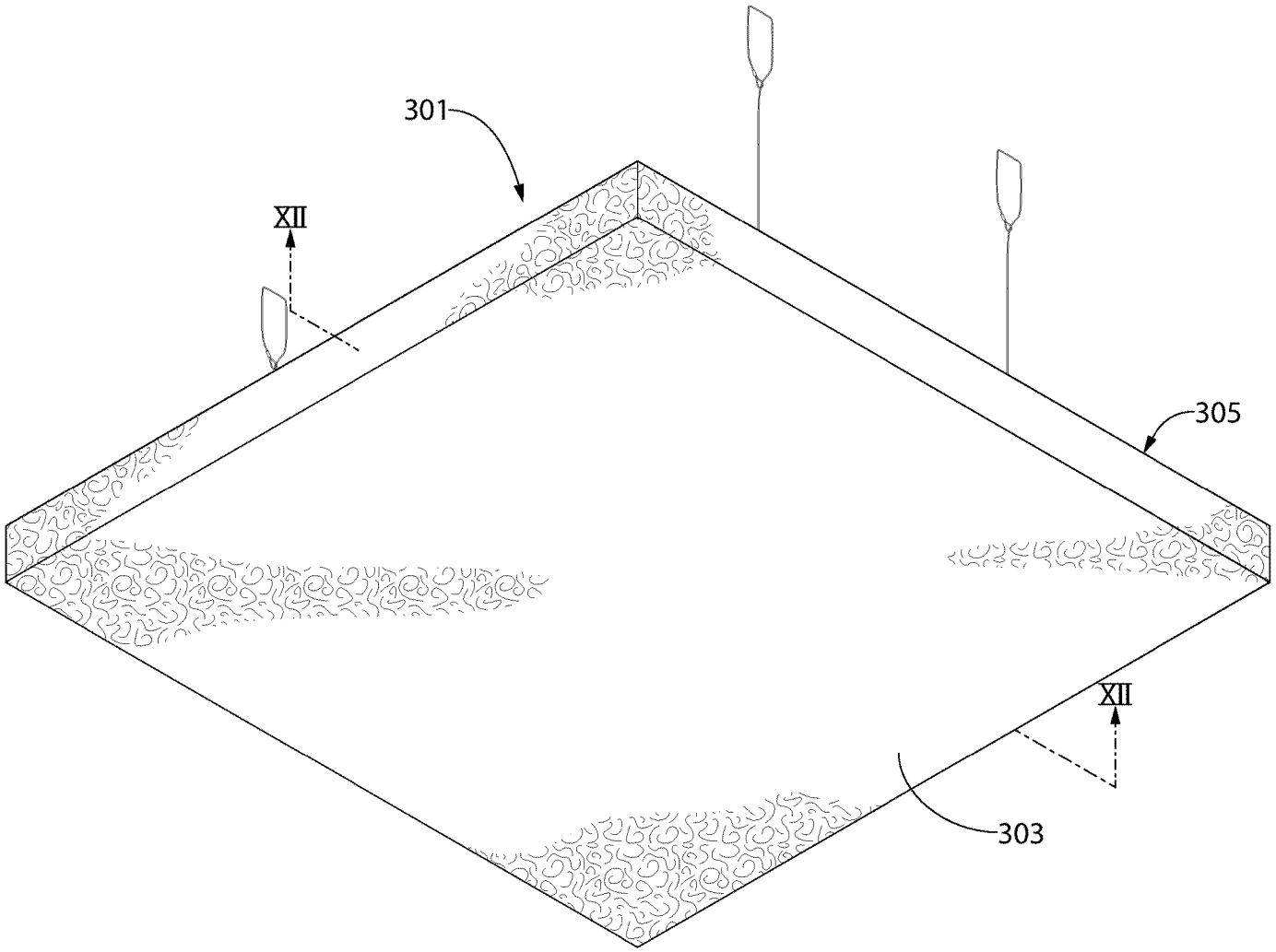
FIG. 11 is a bottom perspective view of a second ceiling structure.
Figure 12:
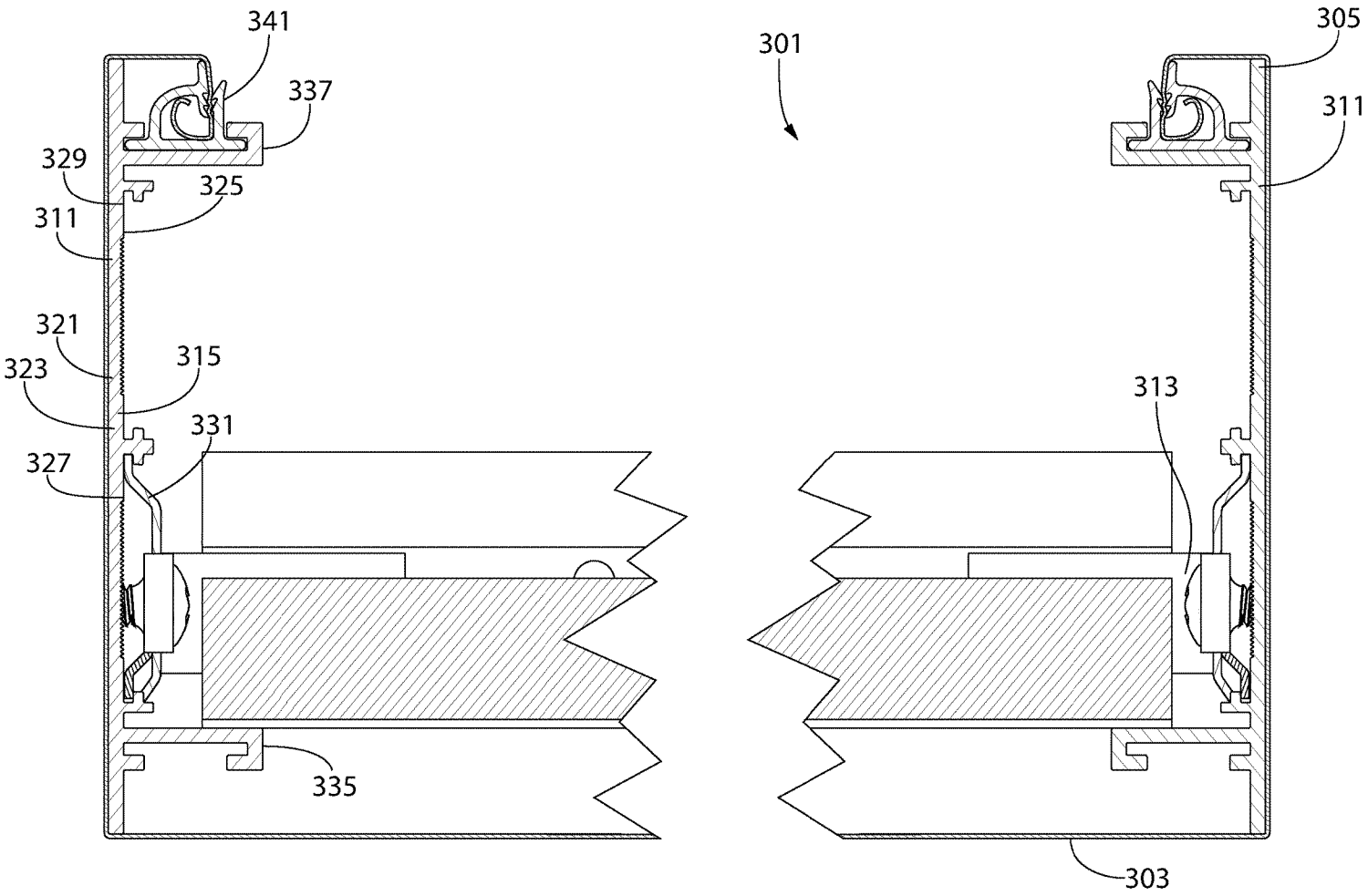
FIG. 12 is a partial cross-sectional view of the second ceiling structure along the line XII-XII of FIG. 11.

FIG. 11 shows a bottom perspective view of an alternative embodiment for a ceiling structure 301. This ceiling structure 301 is has the same essential structure described above with respect to the ceiling structure 13 of FIG. 2, with the exception that the tensioned fabric sheet 303 is coupled to the perimeter frame 307 in a manner so as to wrap around the outer surface of the perimeter frame 307. The cross-sectional view of the ceiling structure 301 shown in FIG. 12 illustrates this difference. Two opposing frame members 311 are each coupled to a longitudinal strut member 313. The profiles of the two frame members 311 show the track 315 that circumscribes the central opening formed by the perimeter frame 307, and as shown, the track 315 is bilaterally symmetric. In certain embodiments, the track 315 may be partially symmetric, or not symmetric at all.

The track 315 includes an upstanding wall 321 which has an outer surface 323 and an inner surface 325. The inner surface 325 includes a lower support element 327 and an upper support element 329. Each of the lower and upper support elements 327, 329 are configured to couple the support brackets 331 to the perimeter frame 307. Each of the lower and upper support elements 327, 329 also permit the support brackets 331 to be coupled to the perimeter frame 307 at a first height (the lower support element 327) or at a second height (the upper support element 329), respectively. The support brackets 331 have the same configuration as the support bracket 85 shown in FIG. 9B.

A lower retaining element 335 protrudes from the inner surface 325 of the upstanding wall 321 at a bottom portion of the upstanding wall 321, and an upper retaining element 337 protrudes from the inner surface 325 of the upstanding wall 321 at a top portion of the upstanding wall 321. As with the track 315, each of the retaining elements 335, 337 circumscribes the central opening of the perimeter frame 307. In certain embodiments, either one or both of the retaining elements 335, 337 may not circumscribed the central opening. In certain embodiments, the lower retaining element 101 may be omitted.

One of the elongated grip bars 341 is placed in sliding relationship with the retaining element 337, and with elongated grip bars 341 so placed with each frame member 311, a fabric gripping member is formed that circumscribes the central opening of the perimeter frame 307. The elongated grip bar 341 of this embodiment may be formed the same as the elongated grip bar 63 shown in FIG. 5B. When the tensioned fabric sheet 303 is engaged by the fabric gripping member, in the manner described above, the tensioned fabric sheet 303 wraps around the outer surface of upstanding wall 321 of the perimeter frame 307 to conceal the outer surface of upstanding wall 321.

Figure 13:
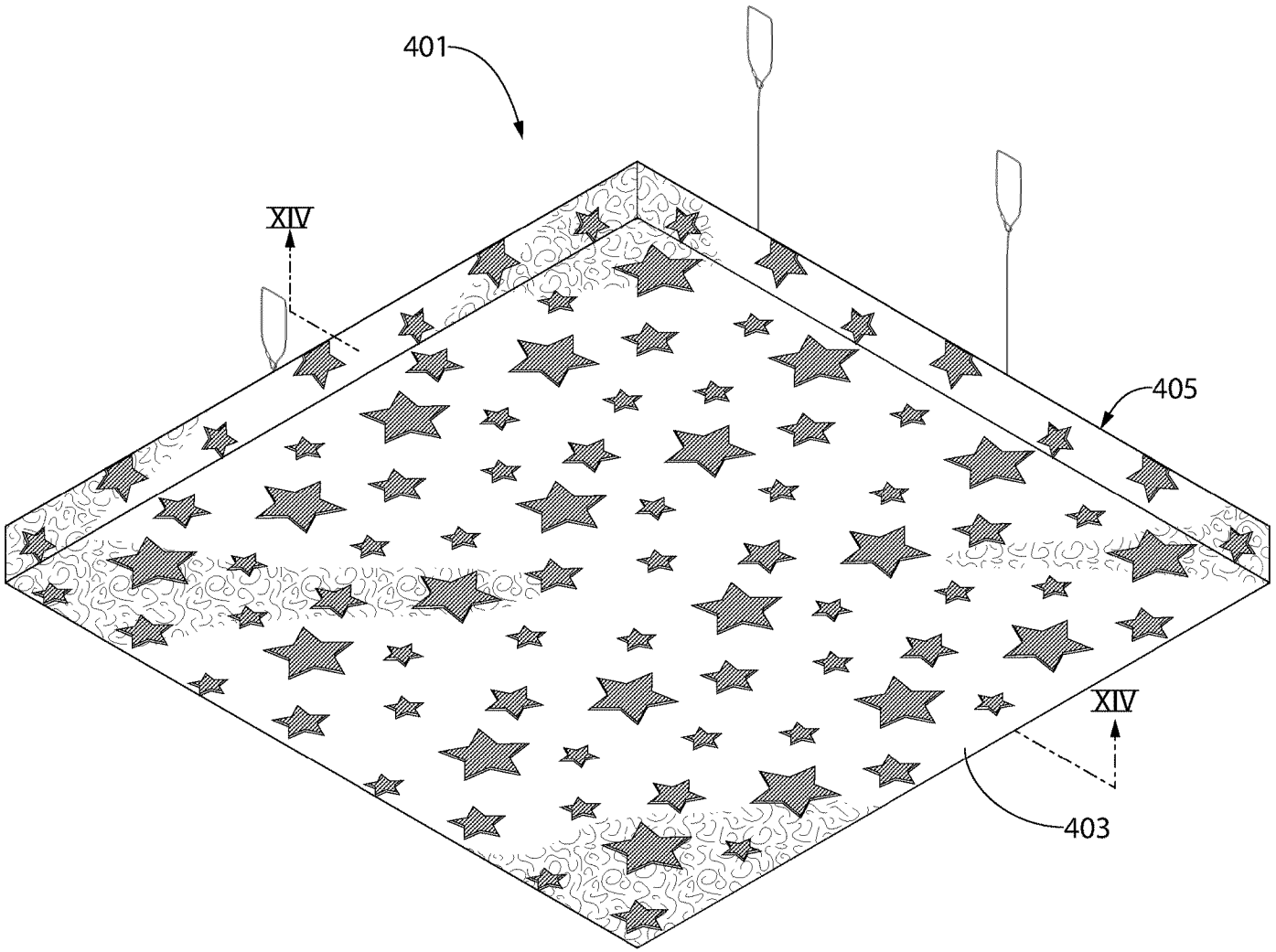
FIG. 13 is a bottom perspective view of a third ceiling structure.
Figure 14:
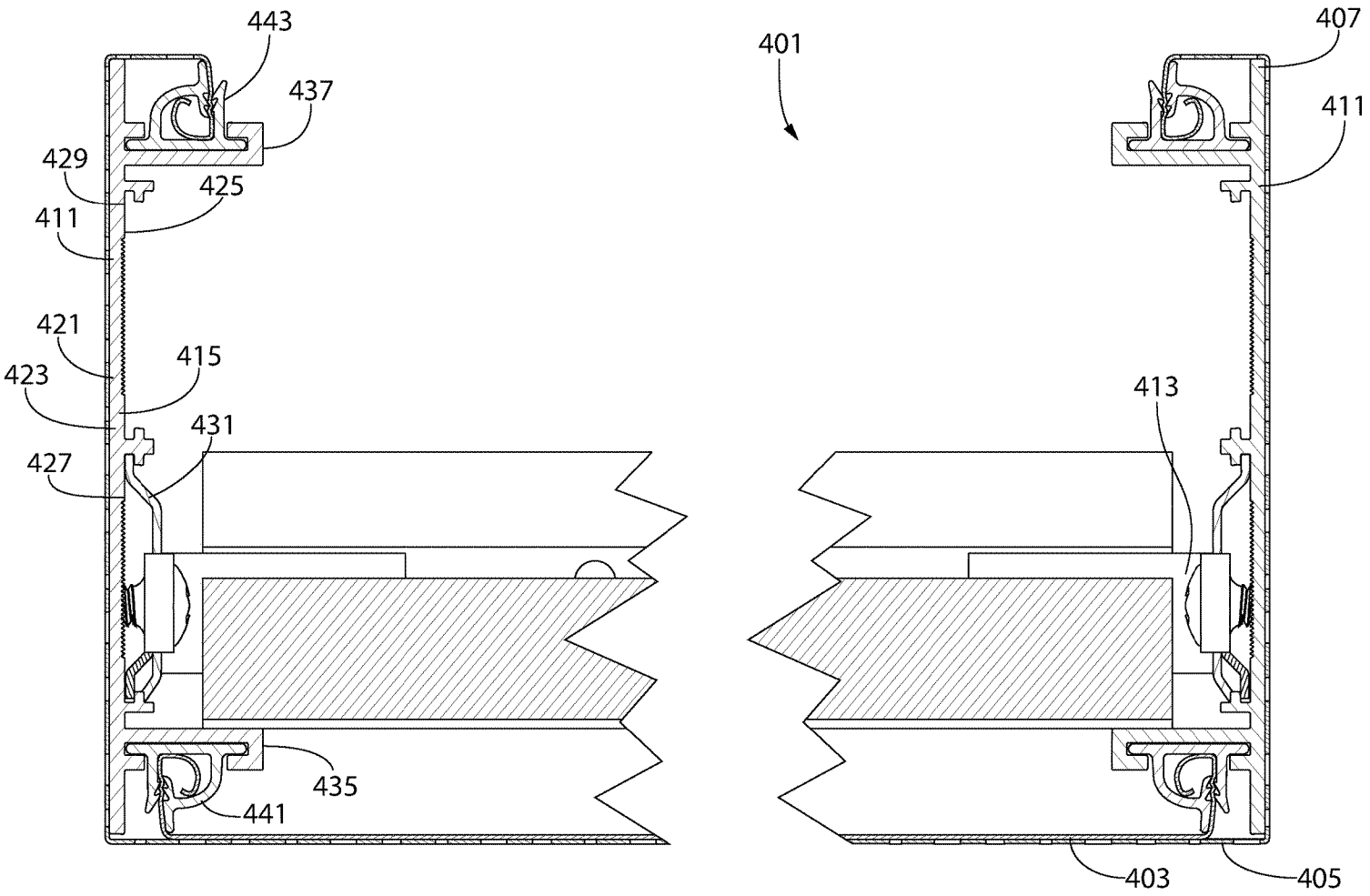
FIG. 14 is a partial cross-sectional view of the third ceiling structure along the line IV-IV of FIG. 13.

FIG. 13 shows a bottom perspective view of an alternative embodiment for a ceiling structure 401. This ceiling structure 401 is has the same essential structure described above with respect to the ceiling structure 13 of FIG. 2, with the exception that the ceiling structure 401 includes two tensioned fabric sheets 403, 405 (the first tensioned fabric sheet 403 is shown in FIG. 14) coupled to the perimeter frame 407 in a manner so that the second tensioned fabric sheets 405 wraps around the outer surface of the perimeter frame 407. The cross-sectional view of the ceiling structure 401 shown in FIG. 14 illustrates this differences. Two opposing frame members 411 are each coupled to a longitudinal strut member 413. The profiles of the two frame members 411 show the track 415 that circumscribes the central opening formed by the perimeter frame 407, and as shown, the track 415 is bilaterally symmetric. In certain embodiments, the track 415 may be partially symmetric, or not symmetric at all.

The track 415 includes an upstanding wall 421 which has an outer surface 423 and an inner surface 425. The inner surface 425 includes a lower support element 427 and an upper support element 429. Each of the lower and upper support elements 427, 429 are configured to couple the support brackets 431 to the perimeter frame 407. Each of the lower and upper support elements 427, 429 also permit the support brackets 431 to be coupled to the perimeter frame 407 at a first height (the lower support element 427) or at a second height (the upper support element 429), respectively. The support brackets 431 have the same configuration as the support bracket 85 shown in FIG. 9B.

A lower retaining element 435 protrudes from the inner surface 425 of the upstanding wall 421 at a bottom portion of the upstanding wall 421, and an upper retaining element 437 protrudes from the inner surface 425 of the upstanding wall 421 at a top portion of the upstanding wall 421. As with the track 415, each of the retaining elements 435, 437 circumscribes the central opening of the perimeter frame 407.

One of the elongated grip bars 441 is placed in sliding relationship with the retaining element 435, and another of the elongated grip bars 443 is placed in sliding relationship with the retaining element 437. Each elongated grip bar 441, 435 of this may be formed the same as the elongated grip bar 63 shown in FIG. 5B. With elongated grip bars 441, 443 so placed with each frame member 411, two fabric gripping members are formed that circumscribes the central opening of the perimeter frame 407. The first tensioned fabric sheet 403 is engaged by the grip bars 441 of the first fabric gripping member, in the manner described above, to tension the first tensioned fabric sheet 403 across the central opening of the perimeter frame 407. The second tensioned fabric sheet 405 is engaged by the grip bars 443 of the second fabric gripping member, in the manner described above, to tension the second tensioned fabric sheet 405 across the central opening of the perimeter frame 407 and to wrap the second tensioned fabric sheet 405 around the outer surface of upstanding wall 421 of the perimeter frame 407 to conceal the outer surface of upstanding wall 421.

With this configuration, the across the central opening of the perimeter frame 407, the upper surface of the second tensioned fabric 405 is adjacent the lower surface of the first tensioned fabric 403. In certain embodiments, the first tensioned fabric sheet 403 may be a first color and the second tensioned fabric sheet 405 may be a second color that is different than the first color. In certain embodiments, the first tensioned fabric sheet 403 may include a loose weaving or even larger holes which allow more of the second tensioned fabric sheet 405 to be seen underneath the first tensioned fabric sheet 403.

What is claimed is:

1. A ceiling system comprising:

a ceiling structure suspended in an interior space, the ceiling structure comprising:

a perimeter frame defining a central opening, the perimeter frame comprising:

a fabric gripping member;

a track comprising a first retaining element configured to couple the fabric gripping member to the track and a second retaining element configured to couple the fabric gripping member to the track; and the fabric gripping member coupled to a selected one of the first or second retaining elements; and a tensioned fabric sheet having a perimeter portion that is engaged by the fabric gripping member of the perimeter frame, the tensioned fabric covering the central opening;

wherein the track comprises an upstanding wall having an inner surface and an outer surface, and wherein each of the first and second retaining elements are located on the inner surface of the upstanding wall; and wherein the first retaining element comprising a first retaining channel and a first access slot forming a passageway into the first retaining channel; and the second retaining element comprising a second retaining channel and a second access slot forming a passageway into the second retaining channel.

2. The ceiling system according to claim 1 wherein the first access slot of the first retaining element faces downward and the second access slot of the second retaining element faces upward.

3. The ceiling system according to claim 1 wherein the first retaining element comprises a floor, a first wall, and a second wall that collectively define the first retaining channel and the first access slot; at least one of first and second walls of the first retaining element comprising an overhang portion; and wherein the second retaining element comprises a floor, a first wall, and a second wall that collectively define the second retaining channel and the second access slot; at least one of first and second walls of the second retaining element comprising an overhang portion.

4. The ceiling system according to claim 3 further comprising:

the fabric gripping member comprising an anchor portion having at least one flange and a gripping portion having first and second gripping jaws that opposed one another;

wherein when the first retaining element is the selected one to which the fabric gripping member is coupled: (1) the anchor portion of the fabric gripping member is disposed in the first retaining channel and the at least one flange of the fabric gripping member mechanically engages the at least one overhang portion of the first retaining element; and (2) the gripping portion of the fabric gripping member protrudes through the first access slot.

5. The ceiling system according to claim 1 wherein the first retaining element is located at a bottom portion of the upstanding wall of the track and the second retaining element is located at a top portion of the upstanding wall of the track.

6. A ceiling system comprising:

a ceiling structure suspended in an interior space, the ceiling structure comprising:

a perimeter frame defining a central opening, the perimeter frame comprising:

a fabric gripping member comprising an anchor portion having at least one flange and a gripping portion having first and second gripping jaws that opposed one another;

a track comprising a first retaining element configured to couple the fabric gripping member to the track and a second retaining element configured to couple the fabric gripping member to the track; and the fabric gripping member coupled to a selected one of the first or second retaining elements; and a tensioned fabric sheet having a perimeter portion that is engaged by the fabric gripping member of the perimeter frame, the tensioned fabric covering the central opening;

wherein the first retaining element comprising a first retaining channel and a first access slot forming a passageway into the first retaining channel; and when the first retaining element is the selected one to which the fabric gripping member is coupled: (1) the anchor portion of the fabric gripping member is disposed in the first retaining channel and the at least one flange of the fabric gripping member mechanically engages at least one overhang portion of the first retaining element; and (2) the gripping portion of the fabric gripping member protrudes through the first access slot.

7. The ceiling system according to claim 6 wherein the second retaining element comprising a second retaining channel and a second access slot forming a passageway into the second retaining channel, and the first access slot of the first retaining element faces downward and the second access slot of the second retaining element faces upward.

8. The ceiling system according to claim 6 wherein the first retaining element comprises a floor, a first wall, and a second wall that collectively define the first retaining channel and the first access slot; at least one of first and second walls of the first retaining element comprising the at least one overhang portion; and wherein the second retaining element comprises a floor, a first wall, and a second wall that collectively define the second retaining channel and the second access slot; at least one of first and second walls of the second retaining element comprising an overhang portion.

9. The ceiling system according to claim 6 wherein the gripping portion of the fabric gripping member comprises a first wall and a second wall, the first wall comprising a first set of teeth and the second wall comprising a second set of teeth, and an access slot located between the first and second set of teeth.

10. The ceiling system according to claim 9, wherein the perimeter portion of the tensioned fabric sheet is located in the access slot of the fabric gripping member and gripped between the first and second set of teeth.

11. The ceiling system according to claim 10, wherein the access slot extends from external the fabric gripping member to an internal cavity within the fabric gripping member, and a side edge of the tensioned fabric is located beyond the first and second set of teeth within the cavity.

* * * * *